US008955600B2

(12) United States Patent
Lauderdale et al.

(10) Patent No.: US 8,955,600 B2
(45) Date of Patent: Feb. 17, 2015

(54) MULTI-BARRIER SYSTEM AND METHOD

(75) Inventors: Donald P. Lauderdale, Cypress, TX (US); Wilfred Schexnayder, Mont Belvieu, TX (US)

(73) Assignee: Baker Hughes Incorporated, Houston, TX (US)

( * ) Notice: Subject to any disclaimer, the term of this patent is extended or adjusted under 35 U.S.C. 154(b) by 541 days.

(21) Appl. No.: 13/080,363

(22) Filed: Apr. 5, 2011

(65) Prior Publication Data

US 2012/0255738 A1 Oct. 11, 2012

(51) Int. Cl.

| | |
|---|---|
| ***E21B 34/06*** | (2006.01) |
| ***E21B 34/10*** | (2006.01) |
| ***E21B 34/14*** | (2006.01) |

(52) U.S. Cl.

CPC ..... *E21B 34/063* (2013.01); *E21B 34/101* (2013.01); *E21B 34/14* (2013.01)

USPC ..... 166/373; 166/316; 166/386

(58) Field of Classification Search

None

See application file for complete search history.

(56) References Cited

U.S. PATENT DOCUMENTS

| | | | | |
|---|---|---|---|---|
| 4,942,926 | A | 7/1990 | Lessi | |
| 5,058,682 | A | 10/1991 | Pringle | |
| 5,372,193 | A * | 12/1994 | French | 166/250.08 |
| 5,465,787 | A | 11/1995 | Roth | |
| 5,831,156 | A | 11/1998 | Mullins | |
| 5,875,852 | A | 3/1999 | Floyd et al. | |
| 6,302,216 | B1 | 10/2001 | Patel | |
| 6,491,102 | B2 * | 12/2002 | Leismer et al. | 166/316 |
| 6,598,675 | B2 | 7/2003 | Bussear et al. | |
| 6,675,893 | B2 * | 1/2004 | Lund | 166/278 |
| 6,695,049 | B2 | 2/2004 | Ostocke et al. | |
| 7,152,688 | B2 | 12/2006 | Richards | |
| 7,219,743 | B2 | 5/2007 | Wolters et al. | |
| 7,228,914 | B2 | 6/2007 | Chavers et al. | |
| 7,322,422 | B2 * | 1/2008 | Patel | 166/387 |
| 7,428,924 | B2 * | 9/2008 | Patel | 166/250.01 |
| 7,430,153 | B2 * | 9/2008 | Fraser et al. | 367/85 |
| 7,487,830 | B2 | 2/2009 | Wolters et al. | |
| 7,617,876 | B2 | 11/2009 | Patel et al. | |

(Continued)

FOREIGN PATENT DOCUMENTS

WO WO 2011005826 A1 * 1/2011

OTHER PUBLICATIONS

Martin P. Coronado et al., "Advanced Openhole Completions Utilizing a Simplified Zone Isolation System"; Socity of Petroleum Engineers, SPE Paper No. 77438; Sep. 29, 2002.

(Continued)

*Primary Examiner* — Jennifer H Gay
*Assistant Examiner* — Caroline Butcher
(74) *Attorney, Agent, or Firm* — Cantor Colburn LLP

(57) ABSTRACT

A multi-barrier system includes a first valve and a second valve that are both in fluidic communication with a lower completion. The first valve and the second valve are positioned proximate an uphole extent of the lower completion, and a member in operable communication with the first valve and the second valve. The system is configured such that both the first valve and the second valve are open when the member is in a first position, the first valve is closed and the second valve is open when the member in a second position, the first valve is open and the second valve is closed when the member is in a third position, and the first valve and the second valve are both closed when the member is in a fourth position. The first valve and the second valve are closable in response to retrieval of an upper completion.

17 Claims, 6 Drawing Sheets

(56) References Cited

U.S. PATENT DOCUMENTS

| | | | | |
|---|---|---|---|---|
| 7,640,977 | B2 | 1/2010 | Jonas | |
| 8,056,628 | B2 | 11/2011 | Whitsitt et al. | |
| 8,286,713 | B2 | 10/2012 | Broussard | |
| 2003/0150622 | A1 | 8/2003 | Patel et al. | |
| 2003/0211768 | A1 | 11/2003 | Cameron et al. | |
| 2004/0159444 | A1 | 8/2004 | Wolters et al. | |
| 2005/0092501 | A1 | 5/2005 | Chavers et al. | |
| 2005/0126789 | A1 | 6/2005 | Nivens et al. | |
| 2006/0151183 | A1 | 7/2006 | Turner | |
| 2007/0084607 | A1* | 4/2007 | Wright et al. | 166/373 |
| 2007/0227727 | A1* | 10/2007 | Patel et al. | 166/250.01 |
| 2007/0235185 | A1 | 10/2007 | Patel et al. | |
| 2007/0295504 | A1 | 12/2007 | Patel | |
| 2008/0223585 | A1 | 9/2008 | Patel et al. | |
| 2009/0025923 | A1 | 1/2009 | Patel et al. | |
| 2009/0078429 | A1 | 3/2009 | Du et al. | |
| 2010/0206579 | A1 | 8/2010 | Guven et al. | |
| 2010/0236774 | A1 | 9/2010 | Patel et al. | |
| 2010/0300702 | A1 | 12/2010 | Andrews et al. | |
| 2011/0192596 | A1 | 8/2011 | Patel | |
| 2012/0138309 | A1 | 6/2012 | Lake | |

OTHER PUBLICATIONS

L. Izquierdo et all, "Managing the Retrieval of Triple-Zone Intelligent Completions in Extended-Reach Wells Offshore California"; Society of Petroleum Engineers, SPE Paper No. 112115; Mar. 4, 2008.

Dwayne Leismer, "A System Approach to Annular Control for Total Well Safety"; Offshore Technology Conference; Paper No. OTC 7349; May 3, 1993.

K. Munday et al., "Want to Make Tree Operations Safer? Why Not Use the DHSV as a Barrier?"; Society of Petroleum Engineers, SPE Paper No. 96337; Sep. 24, 2006; 8 pages.

T.A. Nassereddin et al., "Electromagnetic Surface-Controlled Sub-Surface Safety Valve: An Immediate Soluation to Secure Wells with Damaged Control Line"; Society of Petroleum Engineers, SPE Paper No. 138356; Nov. 1, 2010; 9 pages.

Notification of Transmittal of the International Search Report and the Written Opinion of the International Searching Authority; PCT/US2011/060168; Mailed Jun. 29, 2012; Korean Intellectual Property Office; 10 pages.

Notification of Transmittal of the International Search Report and the Written Opinion of the International Searching Authority; PCT/US2011/063519; Mailed Jul. 30, 2012; Korean Intellecutal Property Office; 8 pages.

Great Britain Search Report for GB Application No. 1303095.2, dated Jun. 24, 2013, pp. 1-5.

* cited by examiner

MULTI-BARRIER SYSTEM AND METHOD

BACKGROUND

In the downhole drilling and completion industry, there is often need to contain fluid within a formation during various operations. Conventionally, a mechanical barrier is put in the system that can be closed to contain the formation fluid when necessary. One example of a system known in the art will use a valve in operable communication with an Electric Submersible Pump (ESP) so that if/when the ESP is pulled from the downhole environment, formation fluids will be contained by the valve. While such systems are successfully used and have been for decades, in an age of increasing oversight and fail safe/failure tolerant requirements, additional systems will be well received by the art.

SUMMARY

Disclosed herein is a multi-barrier system that includes a first valve in fluidic communication with a lower completion and a second valve in fluidic communication with the lower completion. The first valve and the second valve are positioned proximate an uphole extent of the lower completion, and a member in operable communication with the first valve and the second valve. The system is configured such that both the first valve and the second valve are open when the member is in a first position, the first valve is closed and the second valve is open when the member in a second position, the first valve is open and the second valve is closed when the member is in a third position, and the first valve and the second valve are both closed when the member is in a fourth position. The first valve and the second valve are closable in response to retrieval of an upper completion.

Also disclosed is a method of redundantly sealing a wellbore nonpermanently upon retrieval of an upper completion, including retrieving an upper completion from a lower completion, closing a first valve while maintaining a second valve open, closing the second valve while opening the first valve, and closing the first valve while maintaining the second valve closed.

BRIEF DESCRIPTION OF THE DRAWINGS

Referring now to the drawings wherein like elements are numbered alike in the several Figures.

DETAILED DESCRIPTION

Figure 1:
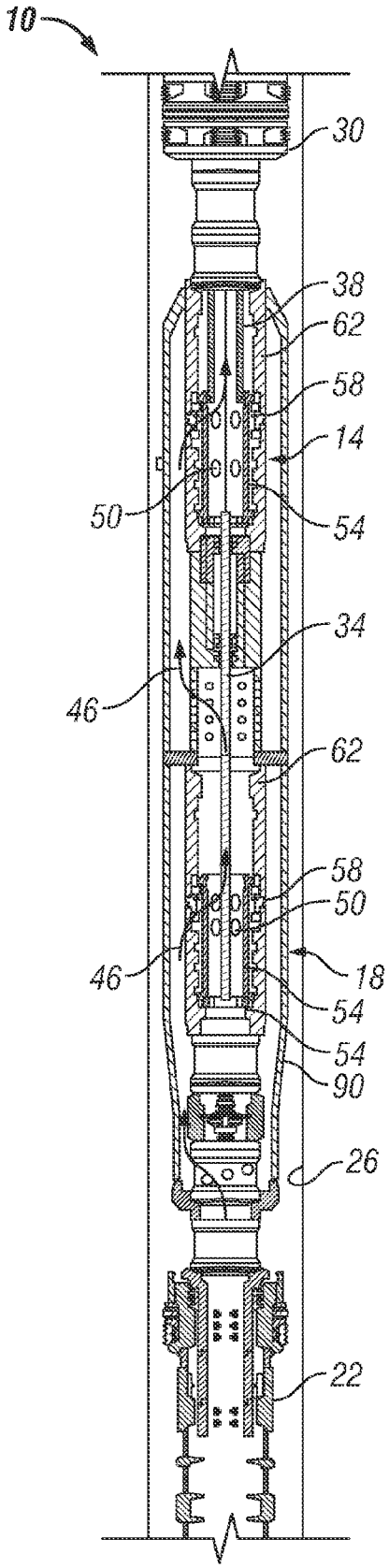
FIG. 1 is a partial cross sectional view of a multi-barrier system disclosed herein.
Figure 2:
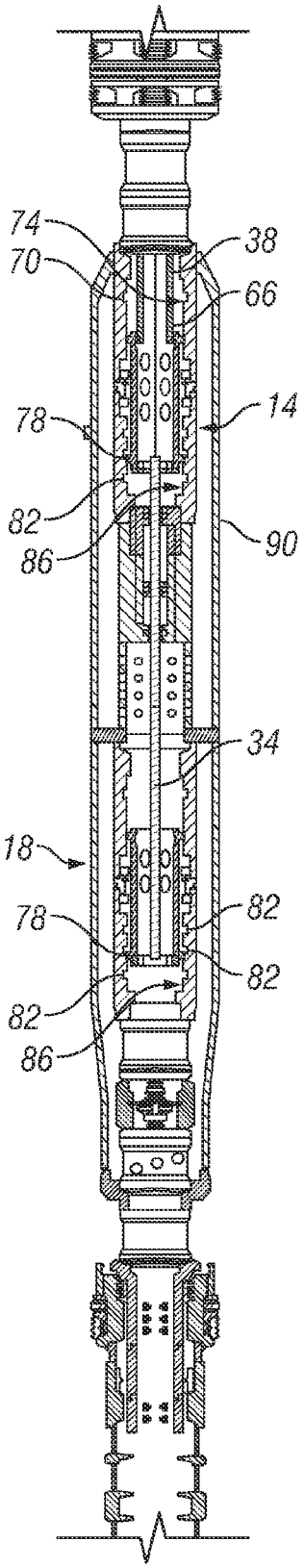
FIG. 2 is a partial cross sectional view of the multi-barrier system of FIG. 1 in an alternate position.

Referring to FIGS. 1 through 4, an embodiment of a multi-barrier system disclosed herein is illustrated at 10. The multi-barrier system 10 includes, a first valve 14 and a second valve 18 in serial fluidic communication with a lower completion 22 that is sealably engaged with a borehole 26 via a seal 30, illustrated herein as a packer. A member 34, illustrated herein as a rod, is operationally connected to the first valve 14 and the second valve 18 such that the valves 14, 18 and the member 34 move in unison. A link 38 connected to an upper completion 42 is operationally connected to the valves 14, 18 and the member 34, such that retrieval of the upper completion 42 causes the link 38 to move the valves 14, 18 and the member 34 to a position wherein both of the valves 14, 18 are closed. As such, the multi-barrier system 10 redundantly seals the lower completion 22 upon retrieval of the upper completion 42. Although the multi-barrier system 10 illustrated in this embodiment employs the two valves 14, 18, any number of valves is contemplated.

Figure 3:
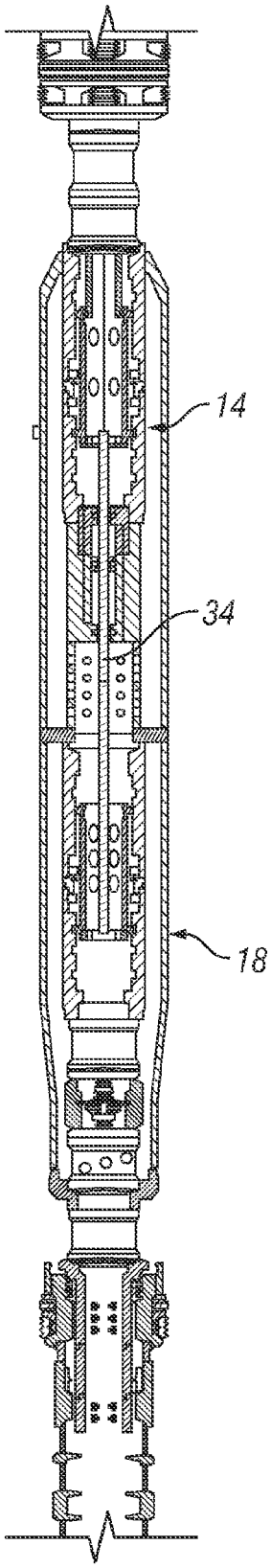
FIG. 3 is a partial cross sectional view of the multi-barrier system of FIG. 1 in an alternate position.

The multi-barrier system 10 is configured such that the member 34 is positionable in at least four positions as illustrated in the FIGS. 1 through 4. In FIG. 1 the member 34 is in a first position and the first valve 14 and the second valve 18 are both open such that fluid can flow between the lower completion 22 and the upper completion 42 as depicted by the arrows 46. The valves 14, 18 are defined as open when any of ports 50 on movable sleeves 54 are aligned with ports 58 on tubulars 62. The longitudinal spacing of the ports 50 in the two valves 14, 18 are situated such that movement of the valves 14, 18 and the member 34 cause a selected open and closing relationship. As such, in FIG. 2 the member 34 is in a second position (moved upward as shown in relation to FIG. 1) and the first valve 14 is closed while the second valve 18 remains open. In FIG. 3, the member 34 is in a third position and the first valve 14 is open while the second valve 18 is closed. And finally, in FIG. 4 the member 34 is in a fourth position and both of the valves 14, 18 are closed. Thus, as the upper completion 42 is retrieved the link 38 is moved (upward in the Figures) thereby causing the valves 14, 18 and the member 34 to move upward sequentially through the first through fourth positions just discussed.

The link 38 is configured with radially flexible fingers 66 (see FIG. 2), such as on a collet to engage with an annular radial groove 70 on an inner surface 74 of the sleeve 54. This engagement allows the movement of the link 38 to cause the valves 14, 18 and the member 34 to shift between at least the four positions identified. Radially flexible fingers 78 on the sleeves 54 engaged with a series of annular radial grooves 82 on an inner surface 86 of a tubular housing 90 that sealingly surrounds the valves 14, 18 to serve as a detent to lock the valves 14, 18 into each of the positions. Forces to relocate the fingers 78 relative to the grooves 82 is less than that required to disengage the fingers 66 from the groove 70 to assure that the valves 14, 18 are movable between the four positions prior to disengagement of the fingers 66 from the groove 70. This relationship assures that during the process of retrieving the upper completion 42 the valves 14, 18 will be moved to the position wherein they are both closed prior to the link 38 disengaging from the groove 70 and being retrieved with the upper completion 42.

Having the ability to close one of each of the valves 14, 18 while the other remains open, allows an operator to independently test the sealing integrity of each of the valves 14, 18.

Figure 4:
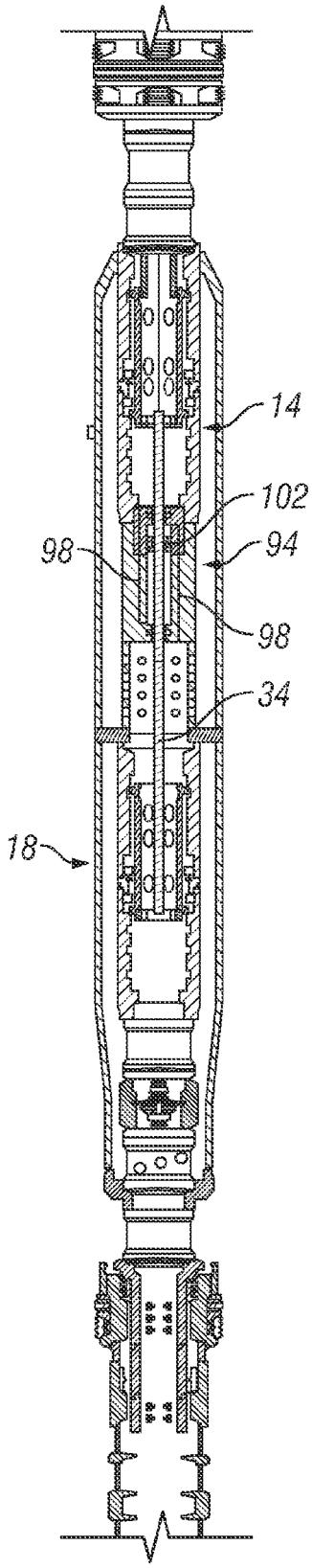
FIG. 4 is a partial cross sectional view of the multi-barrier system of FIG. 1 in an alternate position.

Referring to FIG. 4, a pressure-balancing device 94 is observed that is in operable communication with the member 34. The purpose of the pressure-balancing device 94 is to provide passageways 98 for fluid displaced during movement of the valves 14, 18 and the member 34 (when either or both of the valves 14, 18 are closed), to thereby prevent a hydraulic lock condition from occurring. During movement of the valves 14, 18 and the member 34, fluid is able to move from one side of a piston 102 movable with the member 34 to the other side of the piston 102 through the passageways 98.

Figure 5:
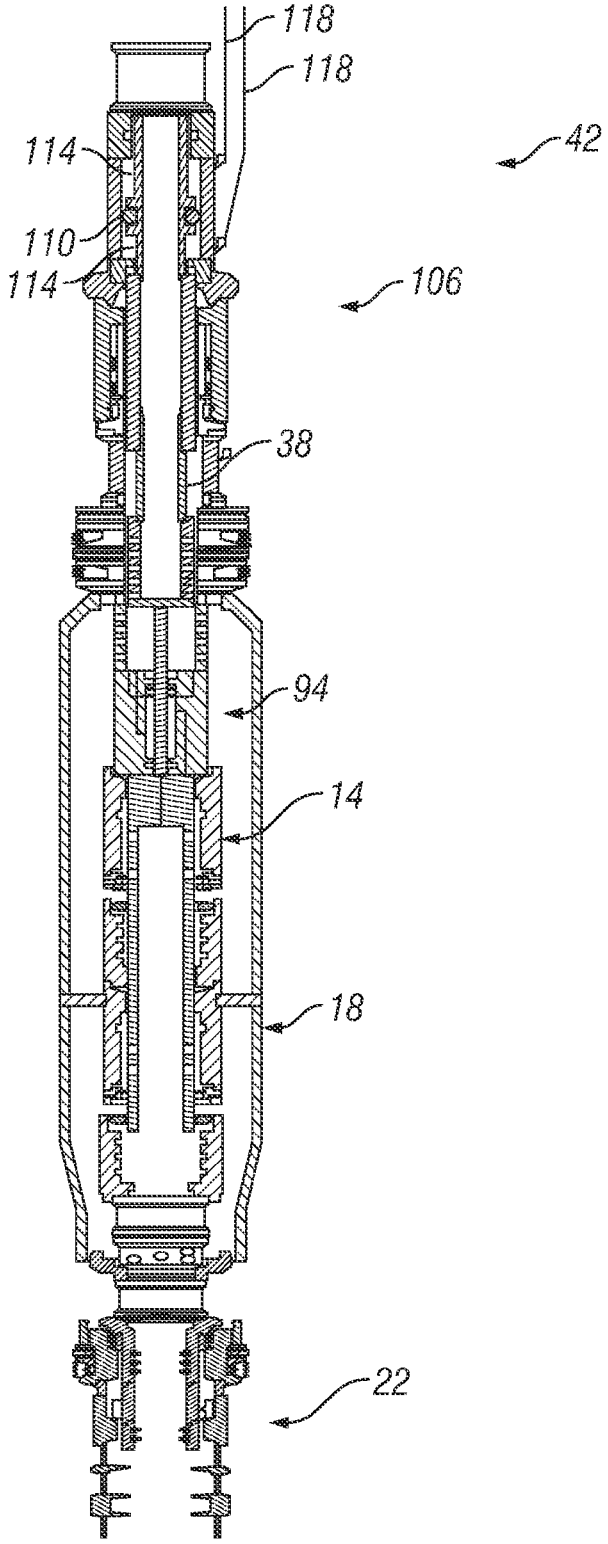
FIG. 5 is a partial cross sectional view of an alternate embodiment of a multi-barrier system disclosed herein.

Referring to FIG. 5, it should be noted that the pressure-balancing device 94 could be located between the two valves 14, 18 as in the embodiment of FIG. 4, or to one side of both of the valves 14, 18 as in the embodiment of FIG. 5.

FIG. 5 also includes a shifting tool 106 configured to move the link 38 to shift the valves 14, 18 between the positions identified. The shifting tool 106 employs a piston 110 with chambers 114 fed by fluid through control lines 118 that can cause the piston 110 to move and thereby shift the link 38 and the valves 14, 18. The shifting tool 106 is part of the upper completion 42 and as such is retrieved, for example to surface, upon retrieval of the upper completion 42. Such retrieval causes the link 38 to move upward, thereby shifting the valves 14, 18 to the closed positions (as discussed above), regardless of whether or not each of the valves 14, 18 is open prior to initiation of retrieval of the upper completion 42. The foregoing structure allows the valves 14, 18 to be actuated by mechanical actuation only, by the link 38. As such, no wet connect of hydraulic lines need be disconnected or reconnecting upon retrieval or reconnection (as will be discussed below) of an upper completion with the lower completion 22. Similarly, for embodiments wherein the shifting tool 106 uses other input for actuation, such as electrical, thermal, or other, for example, as are also contemplated, no disconnection and reconnection other than a mechanical connection of the link 38 is required.

Figure 6A:
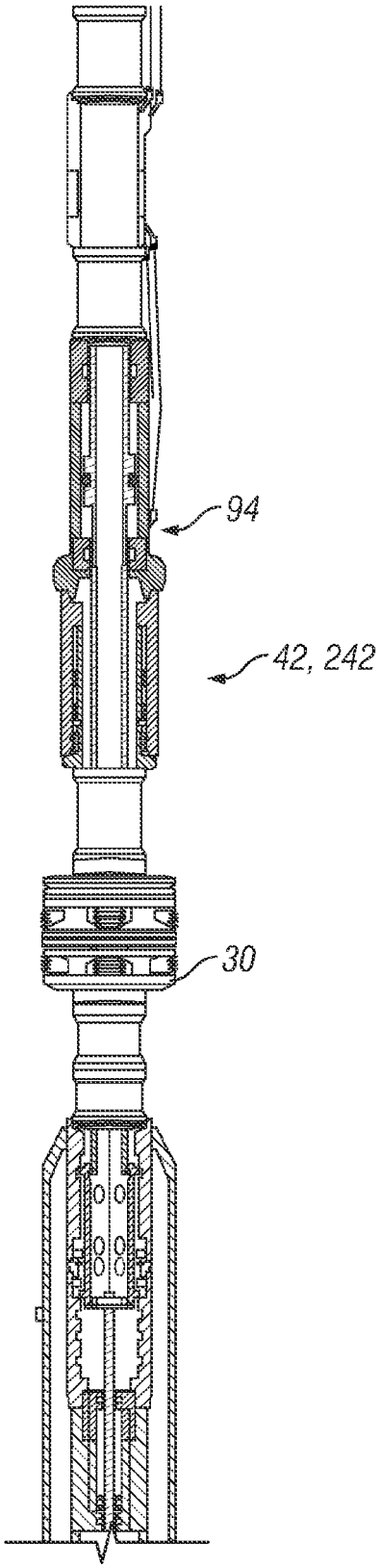
FIGS. 6A-6C is a cross sectional view of a multi-barrier system disclosed herein stacked on the multi-barrier system of FIG. 1.
Figure 6B:
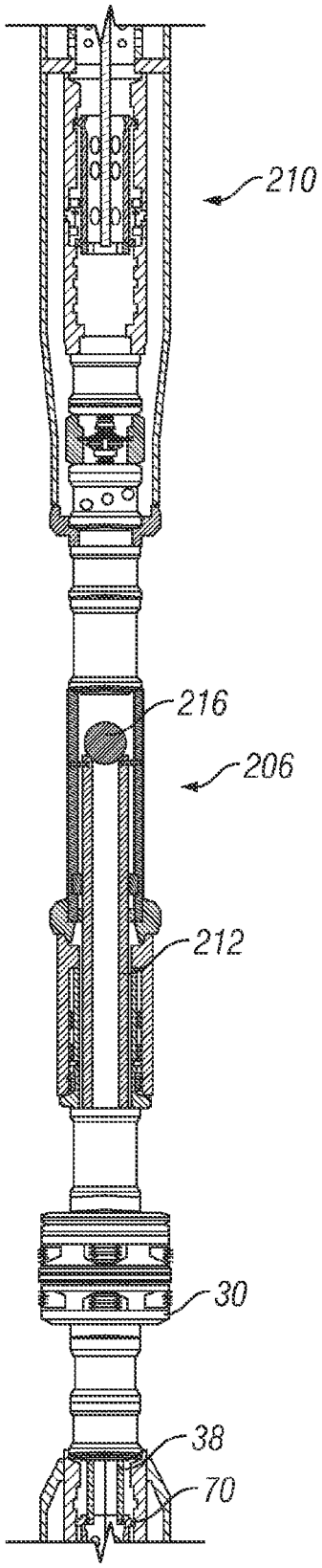
Figure 6C:
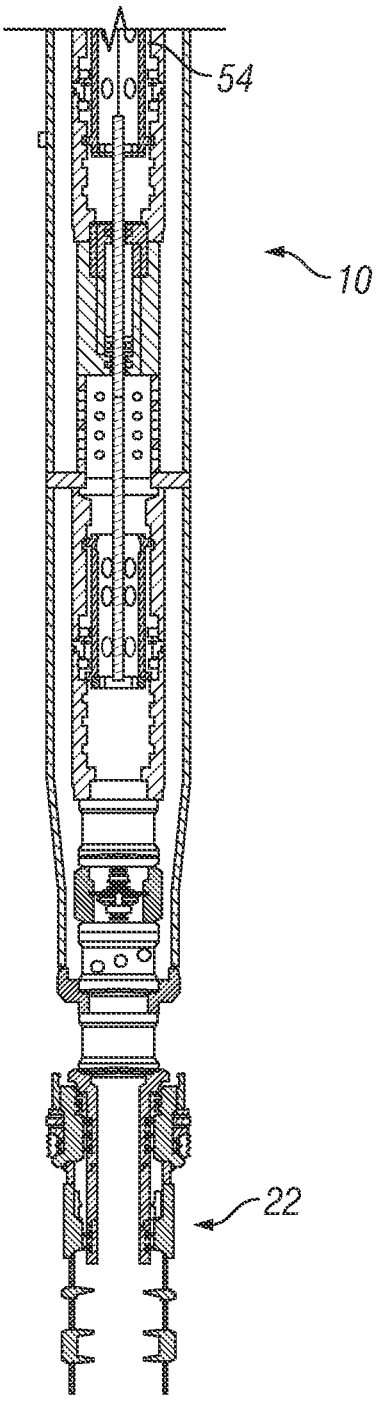

Referring to FIGS. 6A through 6C, a second multi-barrier system 210 is shown functionally attached to the multi-barrier system 10. The second multi-barrier system 210 is connected to a lower portion of the upper completion 42 or a new upper completion 242. The link 38 extending from the upper completion 42, 242 engages with the groove 70 of the sleeve 54 and is configured to open the valves 14, 18 in response to downward movement and repositioning of the valves 14, 18 and the member 34. This downward movement could be due to the engagement of the upper completion 42, 242 with the lower completion 22 or could be due to actuation of an actuator 206 in the upper completion 42, 242. The actuator 206 includes a seat 212 that is connected to the link 38 and is sealable with a plug 216 illustrated herein as a ball. The plug 216 is configured to disappear after pressure has built against the plug 216 while seated against the seat 212 sufficiently to actuate the actuator 26 and shift the valves 14, 18 to their open positions. Materials that are dissolvable in wellbore fluids is an example of a material usable for the plug 216 to facilitate the disappearance thereof. Once the valves 14, 18 are open and the plug 216 has disappeared the newly position multi-barrier system 210 is configured to serve the function that the original multi-barrier system 10 served prior to retrieval of the upper completion 42. Through this manner, any practical number of the multi-barrier systems 10 could be stacked one upon the other.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A multi-barrier system comprising:

a first valve in fluidic communication with a lower completion;

a second valve in fluidic communication with the lower completion, the first valve and the second valve being in series such that flow through one of the first and the second valve also flows through the other of the first and the second valve, the first valve and the second valve being positioned proximate an uphole extent of the lower completion; and a member in operable communication with the first valve and the second valve configured to cause the first valve and the second valve to actuate between open and closed by movement of the member, the member configured to have both the first valve and the second valve open in response to the member being in a first position, the first valve closed and the second valve open in response to the member being in a second position, the first valve open and the second valve closed in response to the member being in a third position, and the first valve and the second valve both closed in response to the member being in a fourth position, each of the first position, the second position, the third position and the fourth position being a different position with each of the four positions of the member being achieved in sequence in response to the member moving in a same direction, the first valve and the second valve being closable in response to retrieval of an upper completion.

2. The multi-barrier system of claim 1, further comprising a seal sealably engagable with the lower completion and a borehole.

3. The multi-barrier system of claim 1, wherein closure of either the first valve or the second valve seals the lower completion.

4. The multi-barrier system of claim 1, wherein sealing integrity of each of the first valve and the second valve are independently testable while closed when the other valve is open.

5. The multi-barrier system of claim 1, further comprising a shifting tool operably connectable with the member.

6. The multi-barrier system of claim 5, wherein the shifting tool is retrievable with the upper completion.

7. The multi-barrier system of claim 5, wherein the first valve and the second valve are openable upon reengagement with an upper completion.

8. The multi-barrier system of claim 1, wherein a plurality of the multi-barrier systems are stackable.

9. The multi-barrier system of claim 1, further comprising a pressure-balancing device in operable communication with at least one of the first valve, the second valve and the member configured to prevent a hydraulic lock condition.

10. The multi-barrier system of claim 1, wherein the first valve and the second valve are actuatable through mechanical linkage to an upper completion.

11. A method of redundantly sealing a wellbore nonpermanently upon retrieval of an upper completion, comprising:

retrieving an upper completion from a lower completion;

moving a member in a same direction during the retrieving;

closing a first valve with movement of the member from a first position to a second position while maintaining a second valve open, the first position being different than the second position;

closing the second valve with movement of the member from the second position to a third position while opening the first valve with the movement of the member from the second position to the third position, the second position being different than the third position;

closing the first valve with movement of the member from the third position to a fourth position while maintaining the second valve closed, the third position being different than the fourth position; and redundantly sealing the wellbore.

12. The method of redundantly sealing a wellbore nonpermanently upon retrieval of an upper completion of claim 11, further comprising disconnecting a shifting tool from operable communication with the first valve and the second valve with the retrieving.

13. The method of redundantly sealing a wellbore nonpermanently upon retrieval of an upper completion of claim 11, further comprising:

connecting an upper completion to the lower completion; and opening the first valve and the second valve.

14. The method of redundantly sealing a wellbore nonpermanently upon retrieval of an upper completion of claim 13, further comprising:

opening the first valve while maintaining the second valve closed; and closing the first valve while opening the second valve.

15. The method of redundantly sealing a wellbore nonpermanently upon retrieval of an upper completion of claim 11, further comprising opening multiple valves in an upper completion connected to the lower completion.

16. The method of redundantly sealing a wellbore nonpermanently upon retrieval of an upper completion of claim 11, further comprising balancing pressure across a member in operable communication with the first valve and the second valve while moving the member.

17. The method of redundantly sealing a wellbore nonpermanently upon retrieval of an upper completion of claim 16, further comprising avoiding a hydraulic lock with the pressure balancing.

* * * * *